US005566893A

United States Patent [19]

Getz

[11] Patent Number: 5,566,893

[45] Date of Patent: Oct. 22, 1996

[54] PORTABLE RECYCLE CRUSHER

[76] Inventor: Roland A. Getz, 2800 W. Lincoln St., Phoenix, Ariz. 85009

[21] Appl. No.: 35,070

[22] Filed: Mar. 22, 1993

[51] Int. Cl.[6] ..... B02C 21/02

[52] U.S. Cl. ..... 241/27; 241/34; 241/81; 241/101.76; 241/186.35

[58] Field of Search ..... 241/185.5, 27, 241/101.7, 34, 186.2, 81, 186.35, 285.1, 186.3, 101.76

[56] References Cited

U.S. PATENT DOCUMENTS

| | | | |
|---|---|---|---|
| 4,339,085 | 7/1982 | Williams | 241/62 |
| 4,585,179 | 4/1986 | Tsuji et al. | 241/101.7 |
| 4,667,886 | 5/1987 | Unland et al. | 241/23 |
| 4,763,845 | 8/1988 | Guggenheimer et al. | 241/101.7 |
| 4,903,903 | 2/1990 | Benen | 241/101.7 |
| 4,928,890 | 5/1990 | Swisher, Jr. | 241/24 |
| 5,181,663 | 1/1993 | Dorscht et al. | 241/81 |
| 5,294,065 | 3/1994 | Harms et al. | 241/101.7 |
| 5,445,330 | 8/1995 | Shokryrashwan et al. | 241/78 |
| 5,476,227 | 12/1995 | Tamura et al. | 241/101.74 |

*Primary Examiner*—John M. Husar

*Attorney, Agent, or Firm*—James Creighton Wray

[57] ABSTRACT

A portable recycle crusher system has a hopper with inward and downward sloping sides, and fold-out hopper extensions. A belt feeder beneath the hopper slides on a slide deck made of a low friction, wear-resistant plastic bolted to a steel plate to prevent tearing of the belt when sharp pointed objects are dumped into the hopper. Stopping and starting and speed of the belt are controlled by remote radio control. Materials fall off the end of the belt feeder onto a scalper, which allows fine materials to bypass a crusher. The materials then enter a large rectangular opening of the crusher, and approach rotating hammers at a proper angle and speed. The hammers strike and break the materials and throw them against abrasion-resistant plates. The broken materials fall between the spinning hammers and through sizing screen steel grates, which provide positive product size control. The materials fall onto a discharge conveyor, which carries the materials away from the recycle crusher and scalper. The hopper, conveyors, crusher and scalper are mounted on a rectangular beam frame, which is supplied with an axle and wheels and a connector for towing the crusher system on roads. An engine mounted on the frame drives a hydraulic pump to operate the feeder and conveyor, and mechanically drives the crusher.

15 Claims, 2 Drawing Sheets

PORTABLE RECYCLE CRUSHER

BACKGROUND OF THE INVENTION

Many portable crushers known in the art are big. They take a lot of time to set up and tear down and are more expensive to transport. They require several people to operate. Overall they cost more in time, parts and labor.

A need exists for a fully self-contained, highly portable recycling crusher which may be transported to sites and which may be loaded and operated by a single person.

SUMMARY OF THE INVENTION

A portable recycle crusher system has a hopper with inward and downward sloping sides, and fold-out hopper extensions. A belt feeder beneath the hopper slides on a slide deck made of a low friction, wear-resistant plastic bolted to a steel plate to prevent tearing of the conveyor belt when sharp pointed objects are dumped into the hopper. Stopping and starting and speed of the feed belt are controlled by remote radio control. Material falls off the end of the belt feeder onto a small scalper, which allows fine material to bypass the crusher. The material then enters a large rectangular opening of the crusher, and approaches rotating hammers at a proper angle and speed. The hammers strike the material and throw it against an abrasion-resistant plate. The material falls between the spinning hammers and through sizing screen steel grates, which provide positive product size control. The material falls onto a discharge conveyor, which carries the material away from the recycle crusher. The hopper, conveyors, crusher and scalper are mounted on a rectangular beam frame, which is supplied with an axle and wheels, lights and a kingpin connector for towing on a fifth wheel. An engine mounted on the frame drives a hydraulic pump to operate the conveyors, and mechanically drives the crusher.

A preferred portable crusher has a frame. A hopper is connected to the frame. A sloped slide deck is connected to the frame beneath the hopper. The slide deck is a low wear, resistant plastic sheet material bolted to steel plates. A belt feeder is positioned under the hopper and is mounted on the slide deck for sliding on the slide deck. The belt feeder has upper and lower power drive and idler rollers. The slide deck helps prevent the tearing of the conveyor belt when sharp pointed objects are dumped into the hopper and onto the belt. A variable speed drive is connected to the power drive roller, and a remote radio control is connected to the variable speed drive for starting and stopping and controlling speed of the belt. A scalping unit is positioned beneath an upper end of the belt. A crusher is positioned beneath the upper end of the belt and the scalper. The crusher has a crushing chamber with a large opening for receiving material from the belt. The crusher has rotating hammers with replaceable tips for striking and fracturing the material which slides into the crusher from the feeder belt. Abrasion-resistant plates in the crushing chamber receives and breaks material thrown against the abrasion-resistant plates by the hammers. Steel size grates and screens below the hammers receive material falling between the hammers from the abrasion-resistant plates. The sizers drop the desirable undersized materials by gravity and return oversized materials to the hammers. A conveyor is connected to the frame and is positioned beneath the crusher and the scalper for conveying small broken materials away from the crusher and scalper.

Preferably fold-out extensions on the hopper extend the hopper to a larger dump area.

The preferred slide deck is a low wear-resistant plastic bolted to a steel base plate.

The frame includes horizontal beams. An axle is connected to the beams, and wheels are connected to the axle for towing the frame over a highway.

Preferably an engine is connected to the frame and a drive chain is connected between the engine and the crusher for driving the crusher. A hydraulic pump is connected to the engine. Hydraulic lines are connected to the pump and hydraulic motors are connected to the lines. Conveyor drive belts are connected to the hydraulic motors and are connected to the power drive rollers for driving the feeder belt and the discharge conveyor.

The preferred crusher has a vertical plate above the vertical plate and an upper sloping plate for impacting materials broken and thrown by the hammers. The crusher has a crusher axle, plural discs connected to the axle and plural hammer axles connected to the discs. Hammers are connected to the hammer axles between each disc. The hammers are eccentrically mounted on the hammer axles, and replaceable hammer tips are extended from the hammer axles.

A preferred embodiment of a transportable crusher plant has a rectangular frame having an axle. Wheels are mounted on the axle and tires are mounted on the wheels for transporting the frame over a roadway. Extendable vertical supports are connected to the frame and are spaced from the wheel axle for supporting the frame at a location. Vertical supports extend above the frame. An upward and forward sloping feeder conveyor is connected to the vertical supports. A hopper has downward and inward sloping side walls connected to the vertical supports near the conveyor for directing materials onto the conveyor. A crusher is mounted on a frame and communicates with an upper end of the feeder conveyor for receiving materials from the conveyor. An engine is connected to the frame and is drivingly connected to the crusher and the conveyor for conveying materials to the crusher, and for crushing materials conveyed to the crusher.

A delivery conveyor is mounted on the frame and extends upward from beneath the crusher to a delivery port. Drive means are connected to the engine for driving the delivery conveyor.

A kingpin fifth wheel connector is connected to the frame remote from the axle for towing the portable crusher with a fifth wheel on a vehicle.

The preferred feeder conveyor is a belt conveyor. Preferably steel plate extends beneath the hopper, and a slide deck is bolted to the steel plate with a low wear, low friction surface on the slide deck for fully supporting a conveyor belt and preventing tearing of the conveyor belt with sharp objects dumped into the hopper and onto the belt.

In a preferred embodiment, a scalper is positioned between the feeder conveyor and the crusher for presorting the material and dropping undersized material before the crusher. Preferably abrasion-resistant plates are mounted in the crusher spaced from the hammer for receiving materials thrown by the hammers.

The preferred method of crushing materials comprises mounting a feed conveyor and a hopper on a frame. The frame is mounted on an axle and wheels for towing the frame and the feed conveyor and crusher to a desired location. Materials are dumped into the hopper and are conveyed with a feed belt sliding along a deck plate covered with a low wear, friction-reducing material. The materials are dumped from the feed belt into a scalper for removing undersized materials. Oversized materials are flowed into the crusher and are impacted with spinning hammers and are flung against abrasion-resistant plates in the crusher. The materials are dropped through sizing grates and onto a delivery container with the scalped fines, and the crushed and undersized materials are delivered with a delivery conveyor.

A portable recycle crushing apparatus of the present invention includes a crusher that combines the features of primary and secondary crushers. In one example, the crusher is mounted on a portable chassis that can be towed by either a one ton flatbed pickup truck with a fifth wheel mounted on the flatbed, or a regular tractor for a semi-trailer. A 6 cubic yard feed hopper has a dump clearance of 7 foot, and has manual fold-out hopper extensions for an 11 foot dump width. A belt feeder conveys materials to the crusher. The belt feeder moves over a slide deck that is a low friction, wear-resistant plastic bolted to a steel plate, instead of conveyor idlers beneath the hopper. The belt feeder with a slide deck positioned under the feed hopper helps prevent tearing of the conveyor belt when materials with sharp pointed objects are dumped onto the belt feeder. The belt feeder is on an 18° to 20° angle, which allows the material to feed into the crushing apparatus in a proper manner. The belt feeder also has a variable speed drive so that the amount of material feeding the crushing apparatus can be automatically increased or decreased. The belt feeder can be started and stopped by remote radio control. The materials falls off the end of the belt feeder onto a small scalping unit which allows the finer material to bypass the crushing apparatus.

The material then enters the 44 inch by 24 inch opening of the crushing apparatus at the proper angle and speed. The material is reduced in several different ways within the crushing apparatus. As the material enters into the crushing chamber it is struck by spinning or rotating hammers, which have replaceable carbide tips. The material is thrown against abrasion-resistant plates and rebounded toward the hammers, and then falls between the spinning hammers and a set of steel grates or sizing screens, which allow for positive product size control. A power source is mounted on the chassis to drive the crusher and the conveyors. The speed of the power source can be changed easily, thereby changing the speed of the hammer tips.

Large chunks can be fed into the crushing apparatus and efficiently and correctly sized in one pass. The material then falls onto a discharge conveyor which carries the material away from the recycle crusher.

The portable crusher, known as a "Portable Rubble Hog", is economical and portable and self-contained. It has a rapid setup which requires only disconnection from the fifth wheel, after dropping the stabilizing jacks into place. It may be towed directly to the site of the rubble, asphalt or concrete, or demolition products, including brick, wood, shingles, glass and soil.

The crusher may be used in recycling operations, particularly for glass or sheet metal or plastic to produce fines for volume reduction and ease in handling and transporting.

The materials from the crusher are ready to be used as aggregate filler materials in construction projects or industrial processes. The hopper may be easily loaded, for example, by a 966 size loader, or a skid steer loader that requires no ramp. The portable crusher is towed easily with a pickup truck, and is a one-man operation which sets up within fifteen minutes. It is fully self-contained. The fully self-contained unit on the highly portable chassis provides high production recycling.

In one example, a device has a capacity of up to 300 tons per hour. It has an extended dump width of 11 feet and a dump clearance of 7 feet. The overall width of the unit is 8½ feet, its length is 29 feet, and it weighs 16,500 lbs.

The preferred chassis has welded heavy-duty I-beams with a single axle having air or electric brakes. A kingpin is mounted beneath the front of the chassis for connection to a fifth wheel for towing, and running, rear and backup lights.

A generator and operation lights may be connected to the engine for providing independent 24-hour operation at remote locations.

The feed hopper in the example has a capacity of 3 cubic yards and is fabricated with quarter inch plate with heavy-duty reinforcing and supports. The belt feeder in the example has a heavy-duty channel 36 inches by 11 feet, with a slide deck which helps prevent tearing of the belt. The belt is driven by a hydraulic variable speed drive. The crusher has eighteen replaceable hammer tips and bolt-in liners. A 24 inch by 44 inch opening accepts large chunks, and the crusher crushes the material to half inch and lower sizes.

The discharge conveyor includes lifetime sealed 20° idlers, a wing tail pulley and drum head pulley. The discharge conveyor is hydraulically driven.

An engine, for example a Detroit Diesel Perkins 1006-6T, turbo charged 6 cylinder engine, produces 160 horsepower at the power takeoff. A Murphy engine control panel is provided in the preferred embodiment.

The hydraulic system includes pumps driven by the engine and motors which are connected to speed reducers for driving the conveyors.

The capacity of the example may be dependent on conditions of the feed and the desired product size.

A further objective of this invention is to provide a crusher which is exceptionally durable, even when used to provide such a recycle crushing apparatus that is of simple construction with few moving parts.

Recyclers will use the invention to help save virgin materials by recycling old materials instead of dumping them into landfills.

Government agencies and contractors will use the invention because of the cost cutting and savings advantages of the unit.

These and further and other objects and features of the invention are apparent in the disclosure, which includes the above and ongoing written specification, with the claims and the drawings.

DETAILED DESCRIPTION OF THE DRAWINGS

Figure 1:
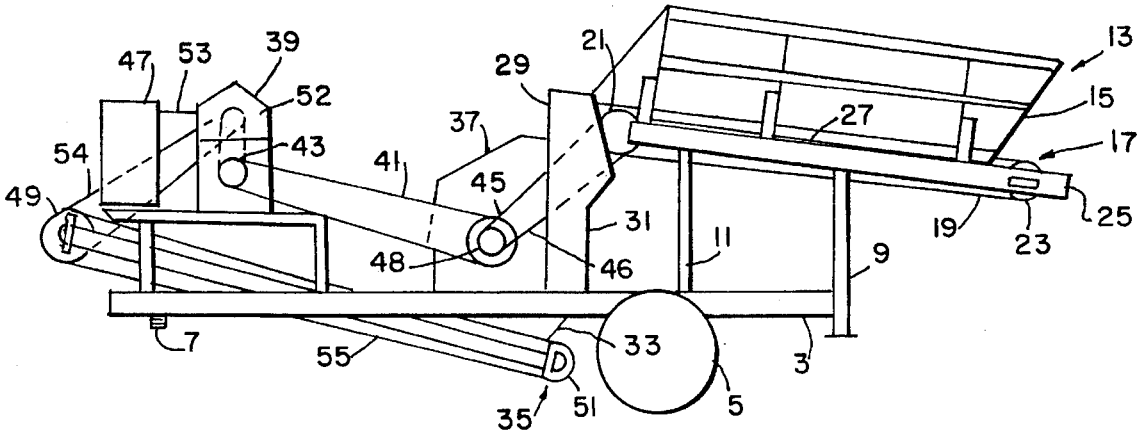
FIG. 1 is a schematic side elevational representation of the portable crusher unit.

Referring to the drawings, the portable crusher is generally referred to by the numeral 1.

Referring to FIG. 1, the portable crusher has a frame 3 with wheels 5 mounted on an axle, and a kingpin 7 for connecting to a fifth wheel of a tractor or truck to transport the system over a highway.

Extensible supports 9 are extended downward to support the portable crusher at the location.

Vertical members 11 support a hopper 13 above the frame. The hopper has upward and outward sloping side walls 15 for directing materials onto a belt feeder 17. The belt feeder has a belt 19 moving around a drive roller 21 and an idler roller 23, which are supported at opposite ends of frame member 25. The drive belt 19 is supported beneath the hopper 13 on a slide plate 27, which has an upper low friction, wear-resistant surface. The belt feeder delivers materials to a scalper 29, which drops the fine materials through a chute 31 and a chute 33 onto a delivery conveyor 35. Materials pass into crusher 37 and are crushed and dropped into the chute 33 and onto the delivery conveyor 35. An engine 39 has a power drive belt 41 connected between gear pulleys 43 and 45 for driving the crusher. A diesel fuel and hydraulic fluid storage structure 47 is provided at a forward end of the frame. The delivery conveyor has an upper drive roller 49 and a lower drive roller 51, and a belt 55 which extends between the drive rollers and which is supported on idler rollers, as is conventional.

Drive belt 46 is connected between rollers 48 and 21 for driving the feeder 17. Storage 47 is connected via line 53 to a hydraulic pump and motor 52, which drives the delivery conveyor 35 by means of drive belt 54 connected to drive roller 49. The belt 55 may be toughened by angularly related idler rollers in a conventional manner to consolidate the crushed materials in the center of the belt.

Figure 2:
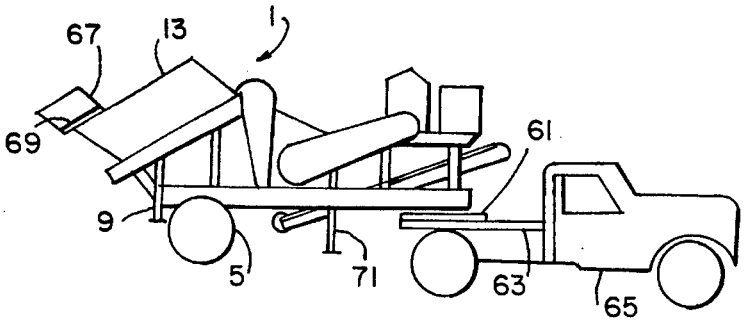
FIG. 2 is a schematic representation of the unit with a kingpin connected to a fifth wheel on a flatbed of a one ton pickup truck.

FIG. 2 shows the portable crusher 1 ready for mounting on the fifth wheel 61 on a flatbed 63 of a one ton pickup truck 65. Extension wings 67 are shown hinged 69 to upper edges of the hopper 13. A forward support 71 cooperates with the rearward extendable support 9 to cooperate with the wheels 5 to support the portable crusher on site.

Figure 3:
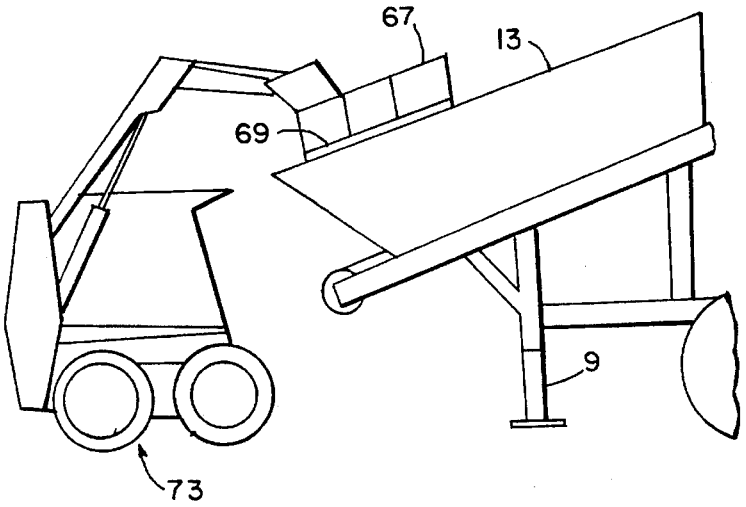
FIG. 3 is a schematic representation of loading the hopper with a skid steer.

As shown in FIG. 3, a skid steer loader is shown dumping materials into the hopper 13 at the site where the portable crusher has been located. The support 9 is shown in the downward position.

Figure 4:
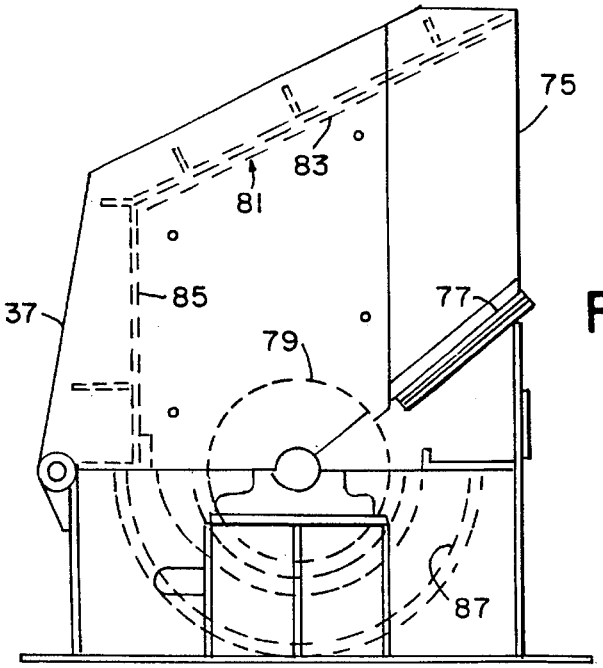
FIG. 4 is a schematic side elevation of the crusher.

As shown in FIG. 4, the crusher 37 has a large opening 75 for receiving the materials to be crushed. The materials slide downward along plate 77 into proper alignment with the spinning hammers, generally indicated by the numeral 79. Abrasion-resistant plates 81 are mounted in a sloping position 83 above the hammers, and vertically 85 beside the hammers. The crushed material falls between the hammers and through a steel grate 87, which acts as a sizing screen.

Figure 5:
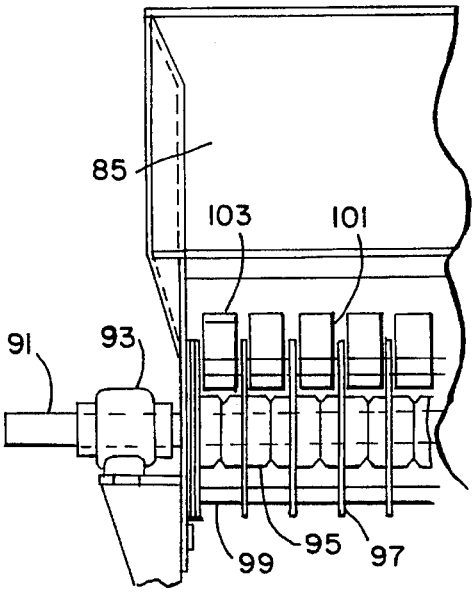
FIG. 5 is a schematic end elevation of the crusher.

A partial side view of the hammer assembly is shown in FIG. 5. The hammers are mounted on a rotating shaft 91, which is supported in a pillow block 93. Clutches 95 are mounted on the shaft, and discs 97 are mounted on the clutches. Hammer axles 99 are carried by the discs, and hammers 101 having replaceable tips 103 are eccentrically mounted on the hammer axles. The hammer assembly extends fully across the crusher, and the materials are struck and broken by the hammers and are flung outward against the plates 83 and 85, where they are further broken. The materials are rebounded towards the hammers, which further break the materials, and eventually the materials fall between the hammers 101 and between the discs 97 and drop through the chute 33, where they are picked by the delivery conveyor.

While the invention has been described with reference to specific embodiments, modifications and variations of the invention may be constructed without departing from the scope of the invention, which is defined in the following claims.

I claim:

1. A portable crusher comprising a frame, a hopper connected to the frame, a sloped slide deck connected to the frame beneath the hopper, the slide deck comprising a low friction, wear resistant plastic bolted to a steel plate, a belt feeder positioned under the hopper for receiving materials from the hopper, mounted on the slide deck for sliding on the slide deck, and the slide deck helping prevent the tearing of the belt feeder when sharp pointed objects are dumped into the hopper and onto the belt feeder, the belt feeder having upper and lower power drive and idler rollers, a variable speed drive connected to the power drive roller, and a remote radio control connected to the variable speed drive for starting and stopping and controlling the drive and the speed of the belt feeder, a scalping unit positioned beneath an upper end of the belt feeder, a crusher mounted on the frame beneath the upper end of the belt feeder, the crusher having a crushing chamber with a large opening for receiving material from the belt, the crusher having rotating hammers with replaceable tips for striking and fracturing the materials which are fed to the crusher by the belt, an abrasion-resistant plate in the crushing chamber for breaking and rebounding material thrown against the abrasion-resistant plate by the hammers, steel sizers adjacent the hammers for receiving material from the hammers and from the abrasion-resistant plate, for dropping undersized materials by gravity and for returning oversized materials to the hammers, and a discharge conveyor connected to the frame and positioned beneath the crusher and the scalper for conveying materials away from the crusher and scalper.

2. The apparatus of claim 1, further comprising fold-out extensions on the hopper for extending the hopper to a larger dump area.

3. The apparatus of claim 1, wherein the slide deck comprises a low wear-resistant plastic bolted to a steel plate.

4. The apparatus of claim 1, wherein the frame further comprises horizontal beams, and further comprising an axle connected to the beams and wheels connected to the axle for rolling the frame over a highway.

5. The apparatus of claim 1, further comprising an engine connected to the frame and a drive chain connected between the engine and the crusher for driving the crusher.

6. The apparatus of claim 5, further comprising a hydraulic pump connected to the engine, hydraulic lines connected to the pump and hydraulic motors connected to the lines, and a conveyor drives connected to the hydraulic motors and connected to power drive rollers for driving the power drive rollers.

7. The apparatus of claim 1, wherein the abrasion-resistant plate further comprises a vertical plate and an upper sloping plate for impacting materials driven by the hammers.

8. The apparatus of claim 1, wherein the crusher comprises a crusher axle, and further comprising plural discs connected to the axle and plural hammer axles connected to the discs, and hammers connected to the hammer axles between the discs, the hammers being eccentrically mounted on the hammer axles, and wherein the hammer tips are extended from the hammer axles.

9. The apparatus of claim 1, further comprising a kingpin fifth wheel connector connected to the frame remote from the axle for towing the portable crusher with a fifth wheel on a vehicle.

10. A transportable crusher plant comprising a rectangular frame having an axle, wheels mounted on the axle and tires mounted on the wheels for transporting the frame over a roadway, extendable vertical supports connected to the frame and spaced from the axle for supporting the frame, vertical supports extending above the frame, an upward and forward sloping feeder conveyor connected to the vertical supports, a hopper having downward and inward sloping side walls connected to the vertical supports above the feeder conveyor for directing materials onto the feeder conveyor, a crusher mounted on a frame and communicating with an upper end of the feeder conveyor for receiving materials from the feeder conveyor and for crushing materials delivered from the feeder conveyor, and engine connected to the frame and drivingly connected to the crusher and the feeder conveyor for conveying materials to the crusher and the feeder conveyor for conveying materials to the crusher, and crushing materials conveyed to the crusher.

11. The apparatus of claim 10, further comprising a delivery conveyor mounted on the frame and extending upward from beneath the crusher and connected to the engine for driving the delivery conveyor.

12. The apparatus of claim 9, wherein the feeder conveyor further comprises a conveyor belt, and further comprising a steel plate extending beneath the hopper and a slide deck bolted to the steel plate with a low wear, low friction surface on the slide deck for fully supporting the conveyor belt and preventing tearing of the conveyor belt with sharp objects dumped into the hopper and onto the belt.

13. The apparatus of claim 9, further comprising a scalper positioned between the feeder conveyor and the crusher for presorting the materials and dropping undersized material before the crusher.

14. The apparatus of claim 9, wherein the crusher further comprises spinning hammers and abrasion-resistant plates spaced from the hammers for receiving and rebounding materials thrown by the hammers.

15. A method of crushing materials comprising mounting a feed conveyor, a hopper and a crusher on a frame, and mounting the frame on an axle and wheels for towing the frame and the feed conveyor and the crusher to a desired location, dumping materials into the hopper, and conveying the materials with a feed belt sliding along a deck plate covered with a low wear, friction-reducing material, dumping the materials from the feed belt into a scalper for removing undersized materials, and flowing the oversized materials into the crusher, impacting the materials with spinning hammers, and driving the materials against abrasion-resistant plates in the crusher, dropping the materials through sizing grates and onto a delivery conveyor with the undersized materials from the scalper, and delivering the crushed and undersized materials with the delivery conveyor, said driving and conveying comprising drivingly connecting an engine to the frame and to the crusher and the conveyor.

* * * * *